US007329059B2

(12) United States Patent
Kawaguchi et al.

(10) Patent No.: US 7,329,059 B2
(45) Date of Patent: Feb. 12, 2008

(54) WIRE DOT PRINTER HEAD AND WIRE DOT PRINTER

(75) Inventors: Takahiro Kawaguchi, Mishima (JP); Yasunobu Terao, Shizuoka (JP); Keishi Tsuchiya, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 313 days.

(21) Appl. No.: 11/073,118

(22) Filed: Mar. 3, 2005

(65) Prior Publication Data

US 2005/0201801 A1 Sep. 15, 2005

(30) Foreign Application Priority Data

Mar. 15, 2004 (JP) ..... 2004-072634

(51) Int. Cl.
*B41J 2/275* (2006.01)

(52) U.S. Cl. ..... 400/124.23; 101/93; 101/93.05; 400/124.22; 400/124.24; 400/124.11; 400/124.17

(58) Field of Classification Search ..... 400/124.23, 400/124.21, 124.01, 124.2, 124.11, 124.13, 400/124.17, 124.18, 124.22, 124.24; 101/93, 101/93.05

See application file for complete search history.

(56) References Cited

U.S. PATENT DOCUMENTS 3,804,224 A 4/1974 Barnaby et al.
4,537,520 A 8/1985 Ochiai et al.
4,552,064 A * 11/1985 Sanders, Jr. et al. ..... 101/93.05
4,674,896 A 6/1987 Yasunaga et al.
4,697,939 A 10/1987 Ara
4,723,854 A 2/1988 Sakaida et al.
4,755,645 A * 7/1988 Naoki et al. ..... 200/276.1

(Continued)

FOREIGN PATENT DOCUMENTS

JP 60124262 7/1985

(Continued)

OTHER PUBLICATIONS

U.S. Appl. No. 10/940,361, Inventor: Kawaguchi et al., filed Sep. 14, 2004.

(Continued)

*Primary Examiner*—Daniel J. Colilla
*Assistant Examiner*—Marissa Ferguson-Samreth
(74) *Attorney, Agent, or Firm*—Frishauf, Holtz, Goodman & Chick, P.C.

(57) ABSTRACT

A wire dot printer head of the present invention has an armature that has an arm supporting a printing wire and pivotably provided at the position opposite to the core, and a coil spring that one end comes in contact with the arm for urging the armature in the direction away from the core, wherein the one end of the coil spring supported by the supporting member is brought into contact with the armature to apply return force to the armature. In order to prevent the breakdown of the armature due to a contact of the coil spring and to realize a stabilized urging operation of the coil spring, a winding end of the coil spring at the one end is located at the position inside of the coil spring and nearer to the supporting member from the contact position where the coil spring comes in contact with the armature.

8 Claims, 6 Drawing Sheets

U.S. PATENT DOCUMENTS

| | | | |
|---|---|---|---|
| 4,767,227 | A | 8/1988 | Mitsuishi et al. |
| 4,802,776 | A | 2/1989 | Miyazawa et al. |
| 4,820,065 | A | 4/1989 | Koyama et al. |
| 4,881,832 | A | 11/1989 | Mitsuishi et al. |
| 4,962,876 | A | 10/1990 | Andou et al. |
| 4,976,554 | A | 12/1990 | Shimosato et al. |
| 4,988,223 | A | 1/1991 | Hilkenmeier et al. |
| 4,993,854 | A | 2/1991 | Sato |
| 5,063,116 | A | 11/1991 | Uchida |
| 5,074,687 | A | 12/1991 | Gugel et al. |
| 5,137,377 | A | 8/1992 | Ito et al. |
| 5,205,659 | A | 4/1993 | Gugel et al. |
| 5,290,112 | A | 3/1994 | Stempfle et al. |
| 5,674,014 | A | 10/1997 | Jordan |
| 5,975,776 | A | 11/1999 | Groenke |
| 6,513,997 | B2 | 2/2003 | Terao |
| 6,682,233 | B2 | 1/2004 | Terao et al. |
| 6,698,956 | B1 | 3/2004 | Terao et al. |
| 6,776,545 | B1 | 8/2004 | Terao |
| 6,805,503 | B1 | 10/2004 | Tsuchiya et al. |
| 6,848,843 | B1 | 2/2005 | Kawaguchi |
| 6,872,016 | B2 | 3/2005 | Kawaguchi |
| 6,994,482 | B2 | 2/2006 | Terao et al. |
| 7,008,126 | B2 | 3/2006 | Kawaguchi |
| 7,018,116 | B2 | 3/2006 | Tsuchiya et al. |
| 7,020,023 | B2 | 3/2006 | Kuramori |
| 7,048,455 | B2 | 5/2006 | Kawaguchi et al. |
| 2003/0175063 | A1 | 9/2003 | Terao et al. |
| 2004/0170461 | A1 | 9/2004 | Kawaguchi |
| 2005/0053407 | A1 | 3/2005 | Kawaguchi |
| 2005/0058488 | A1 | 3/2005 | Kawaguchi |
| 2005/0083764 | A1 | 4/2005 | Kuramori |
| 2005/0160676 | A1 | 7/2005 | Kawaguchi |
| 2005/0201797 | A1 | 9/2005 | Kawaguchi et al. |
| 2005/0201798 | A1 | 9/2005 | Kawaguchi et al. |
| 2005/0201799 | A1 | 9/2005 | Tsuchiya et al. |
| 2005/0201800 | A1 | 9/2005 | Tsuchiya et al. |
| 2005/0201801 | A1 | 9/2005 | Kawaguchi et al. |
| 2005/0207814 | A1 | 9/2005 | Kawaguchi |
| 2005/0207815 | A1 | 9/2005 | Terao et al. |
| 2005/0214052 | A1 | 9/2005 | Kawaguchi et al. |
| 2006/0029449 | A1 | 2/2006 | Kawaguchi |
| 2006/0104696 | A1 | 5/2006 | Kawaguchi |

FOREIGN PATENT DOCUMENTS

| | | | | |
|---|---|---|---|---|
| JP | 62101458 | A | | 5/1987 |
| JP | 02-011336 | A | | 1/1990 |
| JP | 7-22994 | B2 | | 2/1990 |
| JP | 3-007351 | A | | 1/1991 |
| JP | 3-39256 | A | | 2/1991 |
| JP | 03-191036 | A | | 8/1991 |
| JP | 3-288660 | A | | 12/1991 |
| JP | 4-002639 | A | | 1/1992 |
| JP | 4-31061 | A | | 2/1992 |
| JP | 04-105945 | A | | 4/1992 |
| JP | 5-35288 | U | | 5/1993 |
| JP | 6-218954 | A | | 8/1994 |
| JP | 6-227000 | A | | 8/1994 |
| JP | 07-125265 | A | | 5/1995 |
| JP | 09001890 | | * | 1/1997 |
| JP | 09-187972 | A | | 7/1997 |
| JP | 09-314868 | A | | 12/1997 |
| JP | 10-006537 | | | 1/1998 |
| JP | 2833001 | B2 | | 10/1998 |
| JP | 10-291330 | A | | 11/1998 |
| JP | 2850673 | B2 | | 11/1998 |
| JP | 11-78075 | A | | 3/1999 |
| JP | 2944562 | A | | 6/1999 |
| JP | 11-291524 | A | | 10/1999 |
| JP | 2000-280497 | A | | 10/2000 |
| JP | 2001-219586 | A | | 8/2001 |
| JP | 2001253102 | A | | 9/2001 |

OTHER PUBLICATIONS

U.S. Appl. No. 10/940,362, Inventor: Kawaguchi et al., filed Sep. 14, 2004.

U.S. Appl. No. 10/940,492, Inventor: Tsuchiya et al., filed Sep. 14, 2004.

U.S. Appl. No. 10/940,432, Inventor: Kawaguchi, filed Sep. 14, 2004.

U.S. Appl. No. 10/940,338, Inventor: Kawaguchi et al., filed Sep. 14, 2004.

U.S. Appl. No. 11/073,092, Inventor: Terao et al., filed Mar. 3, 2005.

U.S. Appl. No. 11/073,117, Inventor: Tsuchiya et al., filed Mar. 3, 2005.

U.S. Appl. No. 11/073,093, Inventor: Kawaguchi et al., filed Mar. 3, 2005.

Related U.S. Appl. No. 11/246,639, filed Oct. 7, 2005; Inventor: T. Kawaguchi.

Related U.S. Appl. NO. 11/301,412, filed Dec. 13, 2005; Inventor: T. Kawaguchi.

* cited by examiner

WIRE DOT PRINTER HEAD AND WIRE DOT PRINTER

CROSS REFERENCE TO RELATED APPLICATION

The present application is based on Japanese Priority Document P2004-72634 filed on Mar. 15, 2004, the content of which is incorporated herein by reference.

BACKGROUND OF THE INVENTION

1. Field of the Invention

The present invention relates to a wire dot printer head and a wire dot printer using this wire dot printer head, and more particularly to a wire dot printer head having a structure in which an armature is urged by a coil spring in a direction away from a core and a wire dot printer using this wire dot printer head.

2. Discussion of the Background

There has been known a wire dot printer head wherein an armature with a printing wire coupled thereto is pivoted between a printing position and a stand-by position, and when the armature is pivoted to the printing position, a tip of the wire is brought into collision with a printing medium to effect printing. In a certain wire dot printer head of this type, there has been proposed a device wherein a magnetic flux is produced by a coil around the armature, that is to be pivoted, for forming a magnetic circuit that causes the armature to be attracted from a stand-by position to a printing position to effect printing.

In the wire dot printer head of this type, the armature is pivotably supported in the direction away from the core, around which a coil is wound, with the pivot shaft as a center. The armature is urged by a coil spring, serving as an urging member, toward the direction away from the core. The armature described above has an arm supporting the printing wire. The coil spring comes in contact with this arm, wherein the armature is urged in the direction away from the core (see JPU Hei-5(1992)-2639). In the technique disclosed in this publication, a plastic member is provided at the end section of the coil spring for preventing an abrasion at the contact section of the coil spring and the arm, wherein the coil spring is configured to come in contact with the arm via the plastic member.

The armature is required to be violently pivoted as many as 2500 times per second between the printing position and the stand-by position with a recent increased printing speed. Therefore, in case where a winding end 100*a* of a coil spring 100 comes in contact with the side face of an arm 101 as shown in FIG. 6, the winding end 100*a* protrudes toward the arm 101 from the contact position 102 where the coil spring 100 comes in contact with the arm 101, thereby gradually scraping the side face of the arm 101. Finally, the arm 101 is broken from the contact position. Further, a winding end 100*b* of the coil spring 100 comes in contact with a coil supporting member 103 that supports the coil spring 100, whereby it gradually scrapes the coil supporting member 103 during the printing. This causes an unstable urging operation of the coil spring 100, resulting in that high-speed printing is impossible.

On the other hand, even in case where a plastic member is provided at both ends of the coil spring as in the technique disclosed in JPU Hei-5(1992)-2639, the winding end of the coil spring scrapes the plastic member during the printing. Therefore, the plastic member is broken from its contact section. Consequently, the winding end of the coil spring comes in contact with the side face of the arm, gradually scraping the side face of the arm. Further, the broken plastic member hinders the urging operation of the coil spring.

Moreover, the urging operation of the coil spring is not stabilized since it is hindered by the weight of the plastic member, resulting in that high-speed printing is impossible.

SUMMARY OF THE INVENTION

An object of the present invention is to prevent a breakdown of an armature due to a coil spring.

Another object of the present invention is to realize a stabilized urging operation of a coil spring.

A wire dot printer head according to the present invention includes a core around which a coil is wound, an armature that has an arm supporting a printing wire and pivotably provided at the position opposite to the core, a coil spring having one end and another end that the one end comes in contact with the arm for urging the armature in the direction away from the core, and a supporting member that supports the another end of the coil spring for causing a free urging operation of the coil spring, wherein a winding end of the coil spring at the one end is located at the position inside of the coil spring and nearer to the supporting member from a contact position where the coil spring comes in contact with the arm.

A wire dot printer according to the present invention includes the wire dot printer head, a platen opposite to the wire dot printer head, a carriage that holds the wire dot printer head and reciprocates along the platen and a printing medium transporting section that transports a printing medium between the wire dot printer head and the platen.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments for carrying out the present invention will be explained with reference to FIGS. 1 to 5.

[Wire Dot Printer Head]

Figure 1:
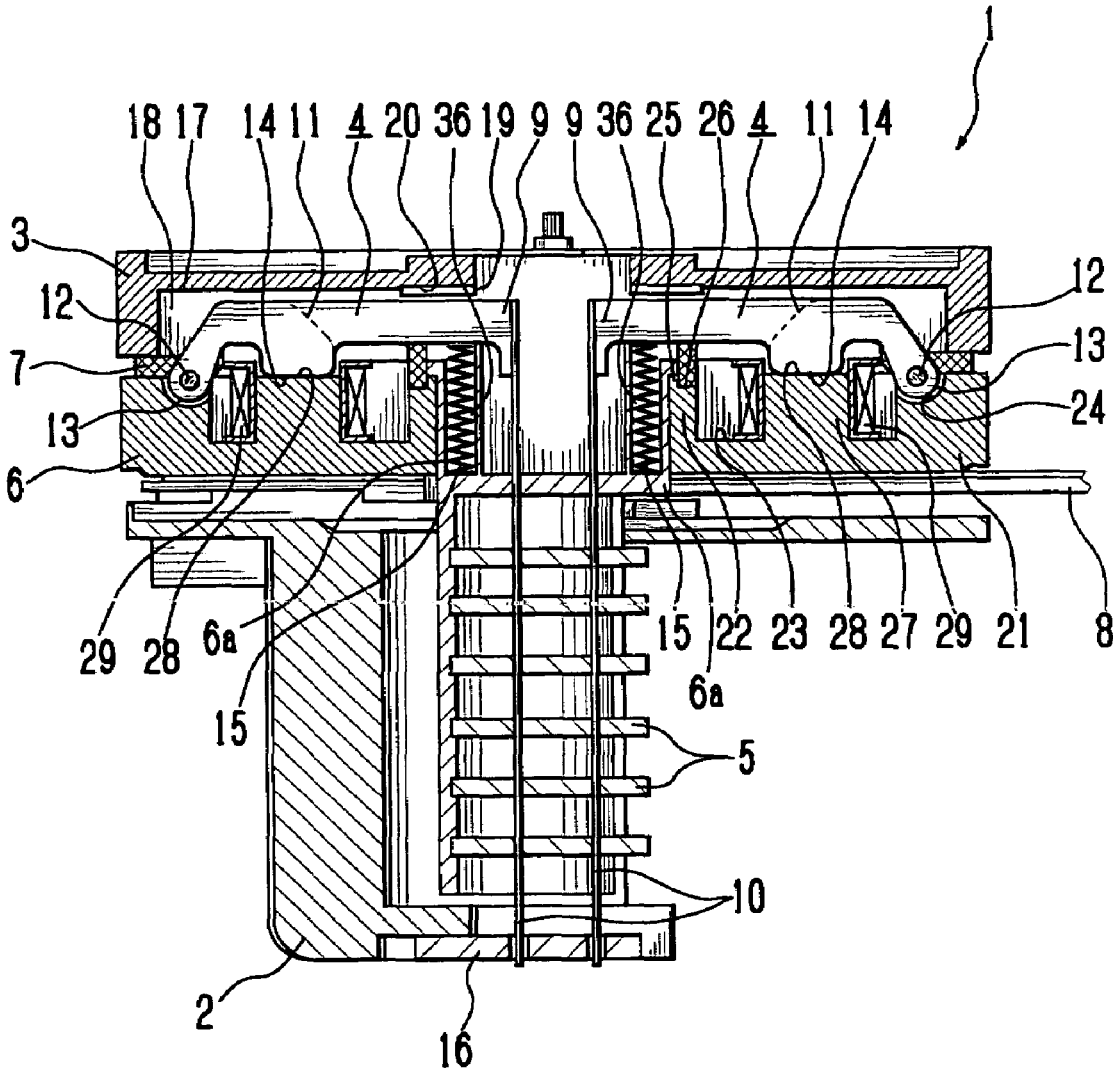
FIG. 1 is a front view in central vertical section schematically showing a wire dot printer head according to one embodiment of the present invention.
Figure 2:
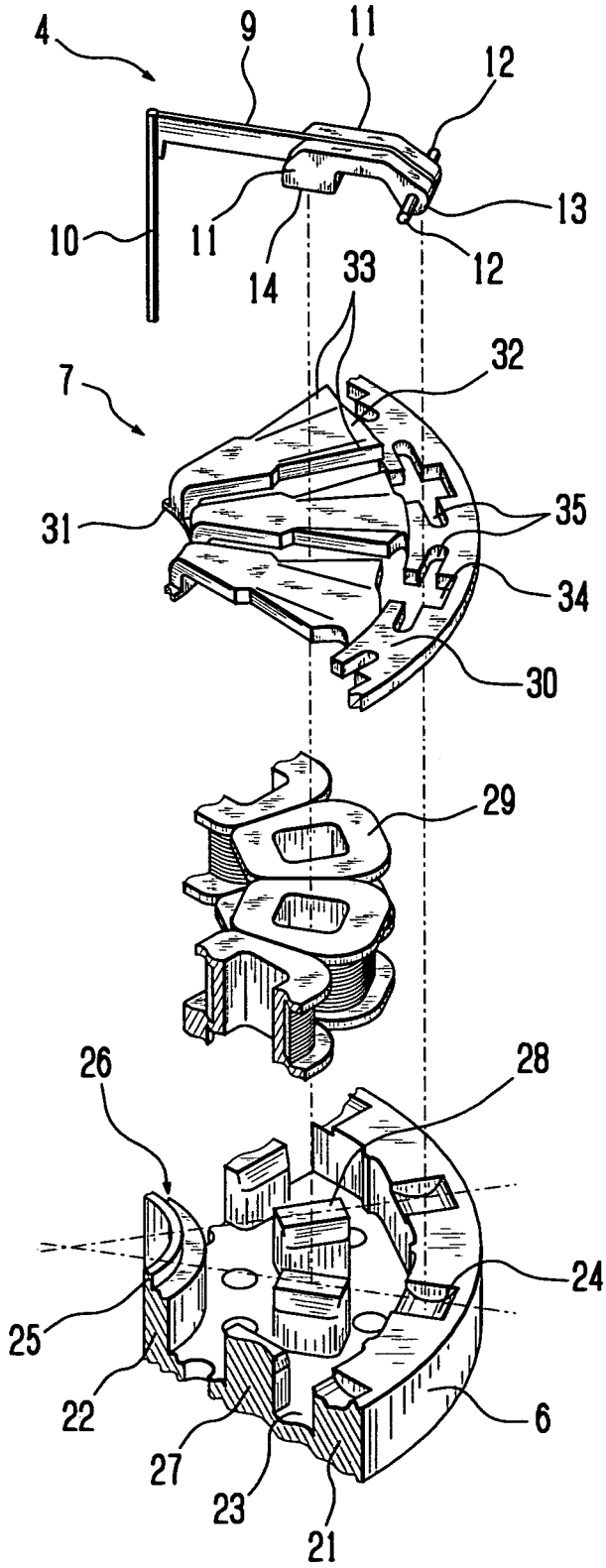
FIG. 2 is an exploded perspective view schematically showing a part of the wire dot printer head according to one embodiment of the present invention.

Firstly, the entire construction of a wire dot printer head 1 will be explained with reference to FIGS. 1 to 4(B). FIG. 1 is a front view in central vertical section schematically showing a wire dot printer head 1 according to the embodiment and FIG. 2 is an exploded perspective view schematically showing a part of the wire dot printer head 1.

The wire dot printer head 1 has a front case 2 and a rear case 3 coupled together with a mounting screw (not shown). Disposed between the front case 2 and the rear case 3 are armatures 4, wire guides 5, yoke 6, armature spacer 7 and circuit board 8.

Each of the armatures 4 has an arm 9 that is formed into a plate-like shape and supports a printing wire (hereinafter simply referred to as a wire) 10 at one end thereof in the lengthwise direction (in the direction in which the arm 9 extends), magnetic circuit forming members 11 formed at both side faces of the arm 9 in the widthwise direction for forming a magnetic circuit and a pivot shaft 12 that is rendered to be a center of the pivot. The wire 10 is soldered to one end of the arm 9. An arc-shaped section 13 is formed at the other end of the armature 4. An attracted face 14 is formed at each of the magnetic circuit forming members 11. This attracted face 14 is positioned at the central section of the armature 4 in the lengthwise direction.

Plural armatures 4 described above are radially arranged with respect to the center of the yoke 6. Each of the armatures 4 is held at the surface of the yoke 6 such that it is pivotable in the direction away from the yoke 6 with the pivot shaft 12 as a center, and it is urged by a coil spring 15 serving as an urging member toward the direction away from the yoke 6. The coil spring 15 is provided at a coil supporting member 6*a* so as to enable the urging operation.

Each of the wire guides 5 slidably guides the wire 10 for causing the tip of the wire 10 to strike against the predetermined position of a printing medium. Further, provided at the front case 2 is a tip guide 16 that aligns the tip of the wire 10 in a predetermined pattern and slidably guides the wire 10. It should be noted that the wire 10 moves to a position where the tip thereof strikes against the predetermined position, e.g., the printing medium such as a sheet or the like, with the pivotal movement of the armature 4, when the armature 4 pivots to the printing position.

A cylindrical section 18 having a bottom face section 17 at the side of one end is provided at the rear case 3. A mounting recess section 20 to which a metallic annular armature stopper 19 is attached is formed at the central portion of the bottom face section 17. The armature stopper 19 is mounted by fitting the armature stopper 19 into the mounting recess 20. When the armature 4 pivots from the printing position by the coil spring 15, the arm 9 as part of the armature 4 comes into contact with the armature stopper 19, thereby stopping the pivotal movement of the armature 4. Therefore, the armature stopper 19 has a function for defining the stand-by position of the armature 4.

The circuit board 8 has a driving circuit for controlling the pivotal movement of the armature 4 between the printing position and the stand-by position. The driving circuit of the circuit board 8 selectively pivots an optional armature 4 among plural armatures 4 during the printing operation.

The yoke 6 is made of a magnetic material and has a pair of cylindrical sections 21 and 22 that are concentrically mounted, each having a different diameter. The size in the shaft direction (in the vertical direction in FIG. 1, i.e., in the shaft direction of the yoke 6) of each cylindrical section 21 and 22 is set equal to each other. The cylindrical section 21 at the outer periphery side and the cylindrical section 22 at the inner periphery side are formed integral by a bottom face 23 formed so as to close one end in the shaft direction. The yoke 6 is held between the front case 2 and the rear case 3 in a state in which its open side opposite to the bottom face 23 is opposed to an open, opposite end side of the rear case 3.

Formed at the outer periphery-side cylindrical section 21 are plural recesses 24 that are equal in number of the armatures 4. Each of the recesses 24 has the inner peripheral face formed into a concave shape having a curvature radius approximately same as that of the outer peripheral face of the arc-shaped section 13 of the armature 4. The arc-shaped section 13 formed at one end of the armature 4 is slidably fitted into the recess 24.

A fitted section 25 having an annular shape is provided at the inner periphery-side cylindrical section 22. The fitted section 25 is integrally provided with the inner periphery-side cylindrical section 22 so as to be positioned concentric with the inner periphery-side cylindrical section 22. The outer diameter of the fitted section 25 is set smaller than the outer diameter of the inner periphery-side cylindrical section 22. Accordingly, a step section 26 is formed at the inner periphery-side cylindrical section 22 by the fitted section 25.

Provided integral with the bottom face 23 are plural cores 27 annually arranged between the outer periphery-side cylindrical section 21 and the inner periphery-side cylindrical section 22. The size of each core 27 in the shaft direction of the yoke 6 is set equal to the size of each cylindrical section 21 and 22 in the shaft direction of the yoke 6.

A pole face 28 is formed at one end of each core 27 in the shaft direction of the yoke 6. The pole face 28 of the core 27 is formed so as to oppose to the attracted face 14 of the magnetic circuit forming member 11 provided at the armature 4. Moreover, a coil 29 is wound around the outer periphery of each core 27. Specifically, the yoke 6 has plural cores 27 annually arranged, each core having the coil 29 wound therearound. Although the winding directions of all coils are set equal to one another in this embodiment, the invention is not limited thereto. For example, coils having different winding directions may be selectively arranged.

The armature spacer 7 has a pair of ring-shaped members 30 and 31 having diameters approximately equal to the diameters of the cylindrical sections 21 and 22 of the yoke 6 and plural guide members 32 radially bridged between the ring-shaped members 30 and 31 so as to be positioned between the armatures 4. These guide members 32 form a side magnetic path with respect to the armature 4. The outer periphery-side ring-shaped member 30 and the inner periphery-side ring-shaped member 31 are concentrically provided. The outer periphery-side ring-shaped member 30, the inner periphery-side ring-shaped member 31 and the guide member 32 are integrally formed.

When the armature spacer 7 is disposed on the yoke 6, the outer periphery-side ring-shaped member 30 and the inner periphery-side ring-shaped member 31 come in contact with the cylindrical sections 21 and 22 of the yoke 6, whereby the inner periphery-side ring-shaped member 31 is fitted to the fitted section 25. It should be noted that the inner diameter of the inner periphery-side ring-shaped member 31 is set equal to or slightly greater than the outer diameter of the fitted section 25.

Each guide member 32 has a side yoke section 33 extending substantially radially of the ring-shaped members 30 and 31 toward the direction away from the pole face 28 of the core 27 and in the oblique direction. This side yoke section 33 has a blade-like shape that is wider toward the outer periphery-side ring-shaped member 30 from the inner periphery-side ring-shaped member 31.

Since the armature spacer 7 has plural guide members 32 bridged between a pair of ring-shaped members 30 and 31, slit-like guide grooves 34 are ensured that are open along the radius direction of the ring-shaped members 30 and 31. Each guide groove 34 is formed to have a width such that the side yoke section 33 comes close to the associated magnetic circuit forming member 11 to such an extent that it does not obstruct the pivot movement of the armature 4.

Further, the guide groove 34 communicates with the outer periphery-side ring-shaped member 30. Formed at the guide groove 34 at the outer periphery-side ring-shaped member 30 is a bearing groove 35 that is a cut-out section open contiguously to the guide groove 34 at the position of both side faces of the guide groove 34 along the outer diameter direction of the ring-shaped member 30. The pivot shaft 12 of the armature 4 is fitted into this bearing groove 35. Specifically, the pivot shaft 12 of the armature 4 is held by the yoke 6 and the armature spacer 7 such that the armature 4 opposes to the core 27.

A pressing member (not shown) for pressing the pivot shaft 12 of each of the plural armatures 4 fitted into the bearing groove 35 is mounted on the armature spacer 7. The pressing member is a plate-like member for pressing the pivot shaft 12 of each of the plural armatures 4 by coupling the front case 2 and the rear case 3 with a mounting screw. This pressing member is annually formed so as not to hinder the pivotal movement of the armature 4.

Figure 3:
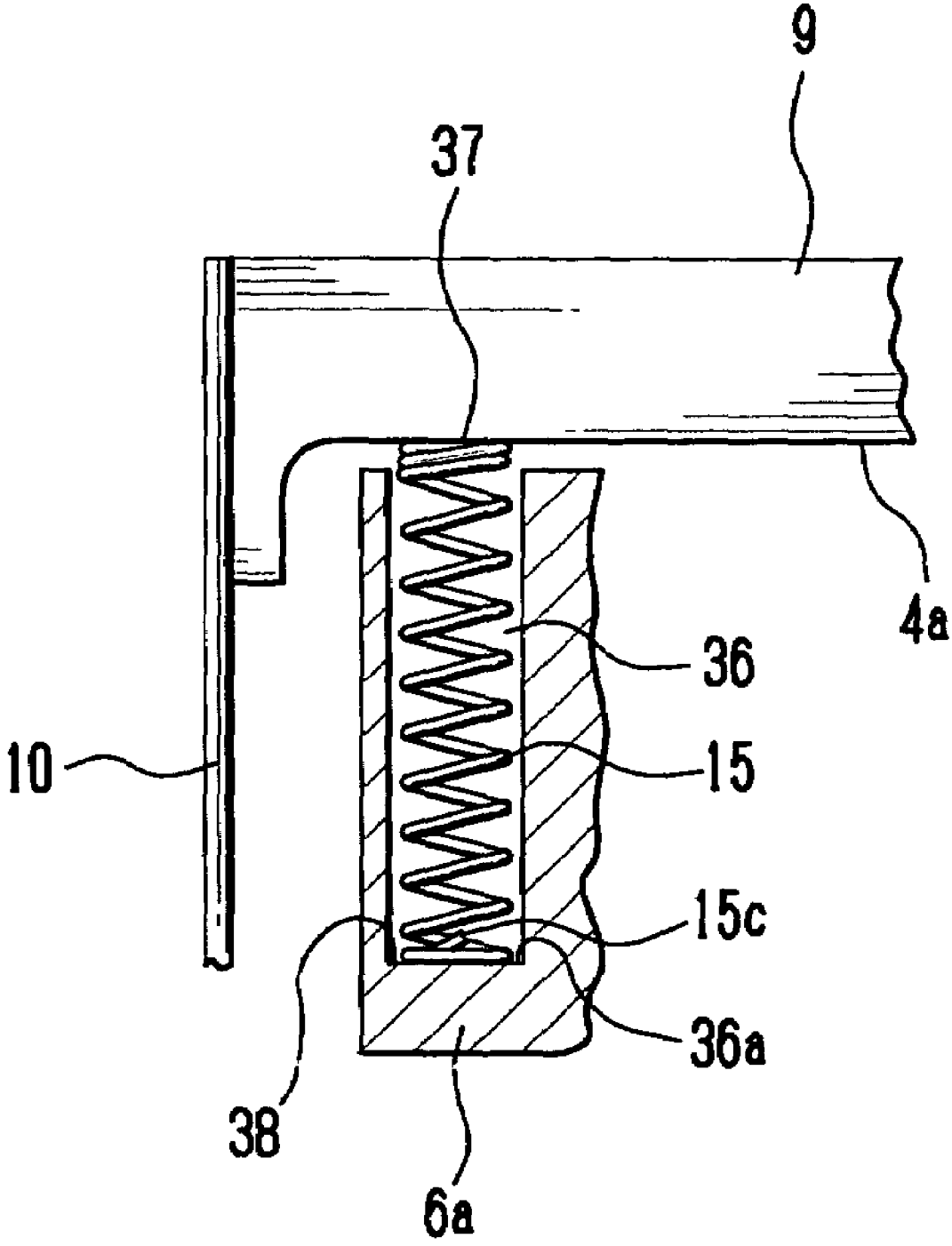
FIG. 3 is a side view schematically showing a coil spring provided at the wire dot printer head according to one embodiment of the present invention.
Figure 4A:
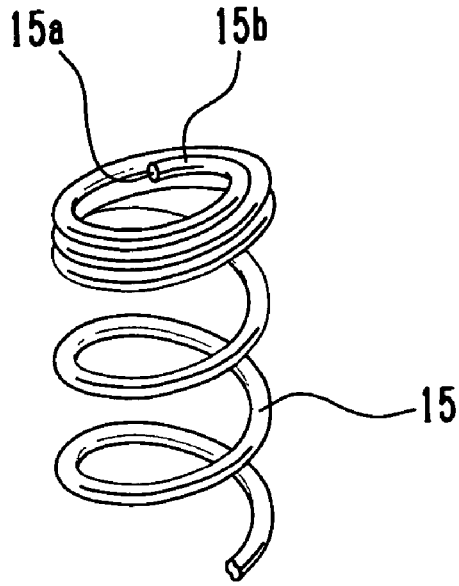
FIG. 4(A) is a perspective view schematically showing both ends of the coil spring provided at the wire dot printer head according to one embodiment of the present invention.
Figure 4B:
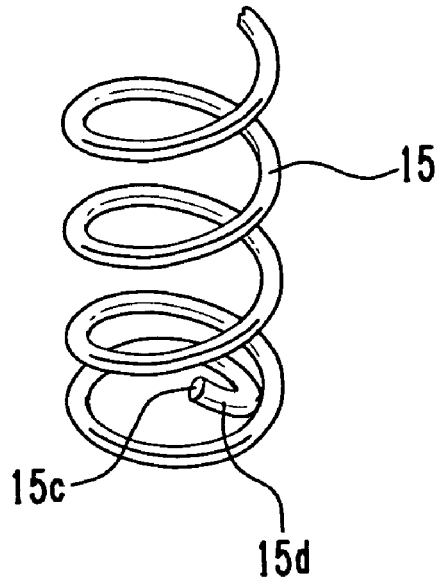
FIG. 4(B) is a perspective view showing an end section at the side of a coil supporting member.

The structure of the coil spring 15 will be explained here with reference to FIG. 3 and FIGS. 4(A) and 4(B). FIG. 3 is a side view schematically showing the coil spring 15, while FIGS. 4(A) and 4(B) show both end sections of the coil spring 15, wherein FIG. 4(A) is a perspective view showing an end section 15*b* at the side of the armature 4 and FIG. 4(B) is a perspective view showing an end section 15*d* at the side of the coil supporting member 6*a*.

The coil spring 15 is provided so as to enable the urging operation to the armature 4 at a hole section 36 that is formed into a cylindrical shape at the coil supporting member 6*a* and has a bottom face 36*a*. The coil supporting member 6*a* is a member for supporting the coil spring 15 so as to enclose the coil spring 15. The coil supporting member 6*a* comes in contact with the coil spring 15 at the bottom face 36*a* of the hole section 36.

A winding end 15*a* of the coil spring 15 at the side contacting to the armature 4 (hereinafter referred to as the armature 4 side) is located at the position that is nearer to the coil supporting member 6*a* from a contact position 37 where the coil spring 15 comes in contact with the armature 4 and is inside (inner) of the coil spring 15. More specifically, the coil spring 15 is formed such that the end section 15*b* at the armature 4 side is along the inside of the coil spring 15, wherein the end section 15*b* forms a part of the contact position 37 where the coil spring 15 comes in contact with the armature 4 (see FIG. 4(A)). This prevents the winding end 15*a* of the coil spring 15 at the armature 4 side from protruding toward the armature 4 from the contact position 37. Specifically, the winding end 15*a* is positioned nearer to the coil supporting member 6*a* from a contact surface 4*a* where the armature 4 comes in contact with the coil spring 15, so that it does not come in contact with the side face or the like of the arm 9 of the armature 4.

Further, a winding end 15*c* of the coil spring 15 at the side contacting to the coil supporting member 6*a* (hereinafter referred to as the coil supporting member 6*a* side) is located at the position that is nearer to the armature 4 from a contact position 38 where the coil spring 15 comes in contact with the coil supporting member 6*a* and is inside (inner) of the coil spring 15. More specifically, the coil spring 15 is formed such that the end section 15*d* at the coil supporting member 6*a* side directs toward the inside central part of the coil spring 15, i.e., toward the armature 4 side (see FIG. 4(B)). This allows the winding end 15*c* of the coil spring 15 at the coil supporting member 6*a* side to be positioned nearer to the armature 4 from the bottom face 36*a* of the hole section 36 at the coil supporting member 6*a*, so that the winding end 15*c* does not come in contact with the coil supporting member 6*a*.

The coil spring 15 is made of a piano wire material (SWP-H type) having tensile strength of 3400 to 3700 $N/mm^2$. This enhances durability of the coil spring 15. Further, the arm 9 of the armature 4 is made of an SK-5 plate material having a thickness of 0.20 mm and subject to a thermal treatment. The width of the arm 9 is set smaller than the width (diameter) of the coil spring 15. Specifically, the arm 9 is formed to have a width in the direction orthogonal to the pivotal direction narrower than the width of the coil spring 15 in its widthwise direction. It should be noted that the coil spring 15 is formed to have a minimum size capable of obtaining urging force coping with high-speed printing.

Although the winding end 15*a* of the coil spring 15 is formed to have the structure shown in FIG. 4(A) as described above and the winding end 15*c* of the coil spring 15 is formed to have the structure shown in FIG. 4(B) as described above in this embodiment, they are not limited thereto. For example, both winding ends 15*a* and 15*c* may be formed to have the same structure shown in FIG. 4(A) or FIG. 4(B).

Although the coil spring 15 is made of a piano wire material (SWP-H type) having tensile strength of 3400 to 3700 $N/mm^2$ in this embodiment, it is not limited thereto. For example, the coil spring 15 may be made of a piano wire material (SWP-B type) having tensile strength of 2940 to 3240 $N/mm^2$.

[Wire Dot Printer]

Figure 5:
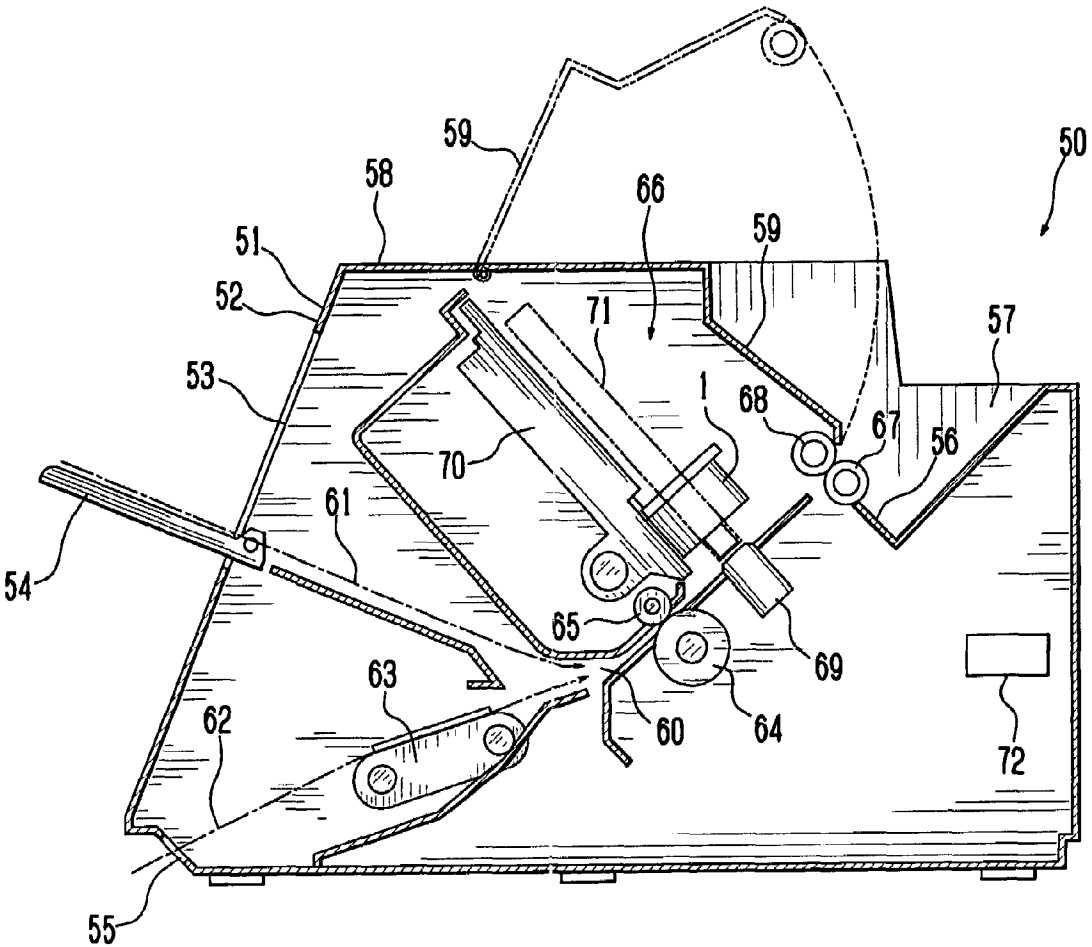
FIG. 5 is a longitudinal side view schematically showing a wire dot printer according to one embodiment of the present invention.
Figure 6:
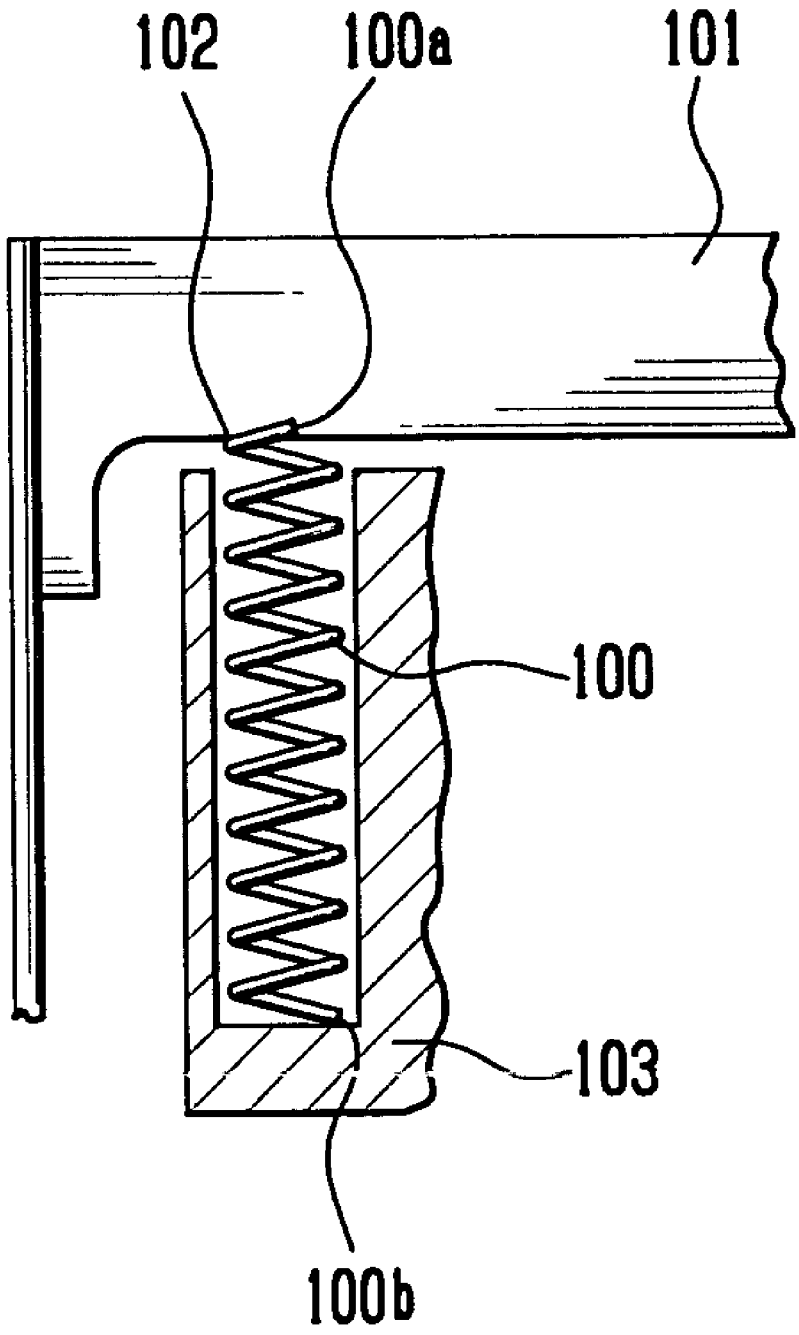
Fig. 6 (PRIOR ART)
FIG. 6 is a side view schematically showing a coil spring provided at a conventional wire dot printer head.

Subsequently explained with reference to FIG. 5 is a wire dot printer 50 provided with the wire dot printer head 1 described above. FIG. 5 is a longitudinal side view schematically showing the wire dot printer 50 according to the embodiment of the present invention.

The wire dot printer 50 has a housing case 51. An opening section 53 is formed at the front face 52 of the housing case 51. A manual tray 54 is mounted at the opening section 53 so as to be able to be opened and closed. Further, a paper feed port 55 is provided at the lower section of the front face 52 of the housing case 51, while a discharge tray 57 is provided at the back face side 56. Moreover, an open/close cover 59 is pivotably provided at the top face 58 of the housing case 51. The opened open/close cover 59 is shown by a virtual line in FIG. 5.

A sheet transporting path 60 that is a printing medium transporting path is provided in the housing case 51. The upstream side in the sheet transporting direction of the sheet transporting path 60 communicates with a paper feed path 61 arranged on the extended face of the opened manual tray 54 and a paper feed path 62 communicating with the paper feed port 55. The downstream side in the sheet transporting direction of the sheet transporting path 60 communicates with the discharge tray 57. A tractor 63 for transporting a sheet is provided in the paper feed path 62.

In the sheet transporting path 60, a transporting roller 64 and a pressing roller 65 are arranged so as to be opposite to each other, wherein the pressing roller 65 comes in pressed contact with the transporting roller 64. These transporting roller 64 and the pressing roller 65 transport a sheet that is a printing medium and compose a sheet transporting section that is a printing medium transporting section. Further, disposed in the sheet transporting path 60 is a printer section 66 that performs a printing operation for the transported sheet. A discharge roller 67 is disposed at the inlet of the discharge tray 57. A pressing roller 68 that comes in pressed contact with the discharge roller 67 is pivotably supported at the side of a free end of the open/close cover 59.

The printer section 66 is composed of a platen 69 arranged in the sheet transporting path 60, a carriage 70 that can reciprocate along this platen 69 in the direction orthogonal to the sheet transporting path 60, the above-mentioned wire dot printer head 1 mounted on the carriage 70 and an ink ribbon cassette 71. It should be noted that the ink ribbon cassette 71 is removably mounted.

The carriage 70 is driven by a motor (not shown) to be reciprocated along the platen 69. The wire dot printer head 1 reciprocates in the main scanning direction with the reciprocating movement of the carriage 70 along the platen 69. Therefore, a head driving mechanism can be realized by the carriage 70 or motor in this embodiment. Further, the wire dot printer 50 has incorporated therein a driving control section 72 for controlling each section in the housing case 51. This driving control section 72 drive-controls each section of the printer section 66, tractor 63 and motor.

In this construction, when a single sheet is used as a sheet, it is fed from the manual tray 54. On the other hand, when plural sheets are continuously used, they are fed from the sheet feed port 55. Either sheet (not shown) is transported by the transporting roller 64, printed by the wire dot printer head 1 and discharged onto the discharge tray 57 by the discharge roller 67.

The printing is performed as follows. Specifically, the coil 29 is selectively excited in the wire dot printer head 1, whereby the armature 4 is attracted by the pole face 28 of the core 27 to be pivoted about the pivot shaft 12, resulting in that the wire 10 is pressed toward the sheet on the platen 69 via the ink ribbon (not shown). When the coil 29 is de-energized, the armature 4 returns under the urging force of the urging member 15 and stops at the stand-by position by the armature stopper 19. Although a sheet is used here as the printing medium, the invention is not limited thereto. For example, a pressure-sensitive color-developing paper can be used in which the color development occurs at the pressurized section. In case where the pressure-sensitive color-developing paper is used as the printing medium, the color development occurs at the section pressurized by the pressure of the wire 10 provided at the wire dot printer head 1, to thereby execute the printing.

Upon performing the printing operation by the wire dot printer 50, a coil 29 is selectively energized based upon the printing data by the control of the driving control section 72. Then, a magnetic circuit is formed among the core 27 on which the selected coil 29 is mounted, the magnetic circuit forming members 11 of the armature 4 opposed to the core 27, a pair of side yoke sections 33 opposed to the magnetic circuit forming members 11, guide members 32, the outer- and inner-periphery side cylindrical portions 21, 22 of the yoke 6, the bottom face 23 and again the core 27.

The formation of this magnetic circuit generates attraction force that attracts the magnetic circuit forming members 11 to the pole face 28 of the core 27 between the attracted face 14 of the magnetic circuit forming member 11 and the pole face 28 of the core 27. This attraction force allows the armature 4 to pivot about the pivot shaft 12 in the direction in which the attracted face 14 of the magnetic circuit forming member 11 is attracted to the pole face 28 of the core 27. It should be noted that the position where the attracted face 14 of the magnetic circuit forming member 11 of the armature 4 comes in contact with the pole face 28 of the core 27 is defined as the printing position in this embodiment.

As a result of the pivotal movement of the armature 4 to the printing position, the tip of the wire 10 projects to the side of the sheet. Since the ink ribbon is interposed between the wire dot printer head 1 and the sheet at this time, the pressure from the wire 10 is transmitted to the sheet via the ink ribbon and the ink from the ink ribbon is transferred onto the sheet, thereby carrying out the printing.

When the coil 29 is de-energized, the magnetism so far developed becomes extinct, so that the magnetic circuit also vanishes. Consequently, the attractive force for attracting the magnetic circuit forming member 11 to the pole face 28 of the core 27 disappears, so that the armature 4 is urged away from the yoke 6 with an urging force of the coil spring 15 and pivots about the pivot shaft 12 toward the stand-by position. The armature 4 pivots toward the stand-by position until its arm 9 comes into contact with the armature stopper 19, whereupon the armature is stopped at the stand-by position.

The printing operation described above is performed at high speed (for example, the printing speed of 2500 times per second). In this case, the winding end 15*a* of the coil spring 15 at the armature 4 side does not protrude toward the armature 4 from the contact position 37, so that it does not come in contact with the side face of the arm 9 of the armature 4. This prevents the damage to the armature 4 due to the coil spring 15, thereby being capable of preventing the breakdown of the armature 4. As a result, long service life of the wire dot printer head 1 can be realized. Further, there is no member provided between the arm 9 of the armature 4 and the coil spring 15 for preventing the contact between them, that means the urging operation of the coil spring 15 is not hindered by such member, with the result that the stabilized urging operation of the coil spring 15 can be realized. Consequently, high-speed printing can be realized.

Moreover, the coil supporting member 6*a* serving as a supporting member encloses the coil spring 15 for its support, wherein the winding end 15*c* of the coil spring 15 at the coil supporting member 6*a* side is located at the position inside of the coil spring 15 and nearer to the armature 4 from the contact position 38 where the coil spring 15 comes in contact with the coil supporting member 6*a*. Therefore, the winding end 15*c* of the coil spring 15 at the coil supporting member 6*a* side does not come in contact with the coil supporting member 6*a*, so that it does not scrape the coil supporting member 6*a*. Consequently, a stabilized urging operation of the coil spring 15 can be realized.

Further, both winding ends 15*a* and 15*c* of the coil spring 15 do not protrude from the inside toward the outside (from the inner side toward the outer side) of the coil spring 15, whereby it is unnecessary to consider the inserting direction (both winding ends 15*a* and 15*c*) of the coil spring 15 upon mounting the coil spring 15 to the hole section 36 of the coil supporting member 6*a*. This facilitates the mounting operation of the coil spring 15 to the hole section 36 of the coil supporting member 6*a*.

The wire dot printer 50 in this embodiment is provided with the above-mentioned wire dot printer head 1, platen 69 opposite to the wire dot printer head 1, carriage 70 that holds the wire dot printer head 1 and reciprocates along the platen 69 and transporting roller 64 and the pressing roller 65 serving as the printing medium transporting section for transporting a printing medium between the wire dot printer head 1 and the platen 69, wherein the wire dot printer head 1, carriage 70, transporting roller 64 and the pressing roller 65 are drive-controlled to effect printing based upon printing data. Therefore, the breakdown of the armature 4 can be prevented, and further, high-speed printing can be realized.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head, comprising:

a core around which a coil is wound;

an armature comprising an arm that supports a printing wire and that is pivotably provided at a position opposite to the core;

a coil spring including a first side which contacts the arm at a first contact position to urge the armature in a direction away from the core; and a supporting member that supports a second side of the coil spring, wherein a winding end of the coil spring at the first side is located at a position inside of the coil spring and away from the first contact position toward the supporting member.

2. The wire dot printer head according to claim 1, wherein the supporting member encloses the coil spring.

3. The wire dot printer head according to claim 2, wherein a winding end of the coil spring at the second side is located at a position inside of the coil spring and away from a second contact position, where the coil spring contacts the supporting member, toward the armature.

4. The wire dot printer head according to claim 1, wherein a winding end of the coil spring at the second side is located at a position inside of the coil spring and away from a second contact position, where the coil spring contacts the supporting member, toward the armature.

5. A wire dot printer, comprising:

(i) a wire dot printer head, comprising:

a core around which a coil is wound;

an armature comprising an arm that supports a printing wire and that is pivotably provided at a position opposite to the core;

a coil spring including a first side with which contacts the arm at a first contact position to urge the armature in a direction away from the core; and a supporting member that supports a second side of the coil spring, wherein a winding end of the coil spring at the first side is located at a position inside of the coil spring and away from the first contact position toward the supporting member;

(ii) a platen opposite to the wire dot printer head;

(iii) a carriage that holds the wire dot printer head and reciprocates along the platen; and (iv) a printing medium transporting section that transports a printing medium between the wire dot printer head and the platen.

6. The wire dot printer according to claim 5, wherein the supporting member encloses the coil spring.

7. The wire dot printer according to claim 6, wherein a winding end of the coil spring at the second side is located at a position inside of the coil spring and away from a second contact position, where the coil spring contacts the supporting member, toward the armature.

8. The wire dot printer according to claim 5, wherein a winding end of the coil spring at the second side is located at a position inside of the coil spring and away from a second contact position, where the coil spring contacts the supporting member, toward the armature.

* * * * *